US006572062B1

(12) United States Patent
Limber et al.

(10) Patent No.: US 6,572,062 B1
(45) Date of Patent: Jun. 3, 2003

(54) GUTTER CLIP FOR ATTACHMENT OF LINEAR SYSTEMS

(75) Inventors: Jamie A. Limber, Gilbert, AZ (US); Robert I. Vasquez, Phoenix, AZ (US)

(73) Assignee: The Christmas Light Company Inc.

( * ) Notice: Subject to any disclaimer, the term of this patent is extended or adjusted under 35 U.S.C. 154(b) by 62 days.

(21) Appl. No.: 10/173,723

(22) Filed: Jun. 17, 2002

(51) Int. Cl.[7] ..... A47B 96/00

(52) U.S. Cl. ..... 248/227.1; 248/229.16; 248/229.26

(58) Field of Search ..... 248/227.1, 48.1, 248/48.2, 200, 229.16, 229.26, 230.7; 362/250, 396, 287, 285, 430; 24/339

(56) References Cited

U.S. PATENT DOCUMENTS

| | | | | |
|---|---|---|---|---|
| 2,658,247 | A | 11/1953 | Heuer | |
| 3,124,327 | A | 3/1964 | Meszaros | 248/74.1 |
| 3,181,827 | A | 5/1965 | Sassin | 248/74.1 |
| 3,182,944 | A | 5/1965 | Laviano | 248/226.1 |
| 3,189,310 | A | 6/1965 | Trueson | 248/314 |
| 3,193,229 | A | 7/1965 | Stock | 248/74.1 |
| 3,438,604 | A | 4/1969 | Spicer | 248/74.1 |
| 3,540,687 | A | 11/1970 | Cava | 248/316.1 |
| 3,578,282 | A | 5/1971 | Olsen | |
| 3,584,795 | A | 6/1971 | Baird | 240/52 |
| 3,599,916 | A | 8/1971 | Szabo | 248/73 |
| 3,599,918 | A | 8/1971 | Patchett | |
| 3,861,632 | A | 1/1975 | Siilats | |
| 3,883,926 | A | 5/1975 | Reynolds | 24/73 |
| 4,491,902 | A | 1/1985 | Cangelosi | 362/389 |
| D298,738 | S | 11/1988 | Rumpel | |
| 4,851,977 | A | 7/1989 | Gary | 362/249 |
| 4,905,131 | A | 2/1990 | Gary | 362/249 |
| D316,958 | S | 5/1991 | Rumpel | |
| D317,115 | S | 5/1991 | Gary | |
| D317,252 | S | 6/1991 | Rumpel | |
| D319,575 | S | 9/1991 | Young | |
| 5,056,747 | A | 10/1991 | Kireta | 248/231.8 |
| D324,990 | S | 3/1992 | Gary | |
| D325,866 | S | 5/1992 | Gary | |
| 5,141,192 | A | 8/1992 | Adams | 248/231.8 |
| D331,360 | S | 12/1992 | Adams | |
| 5,249,108 | A | 9/1993 | Gary | 362/388 |
| 5,388,802 | A | 2/1995 | Dougan et al. | 248/74.2 |
| D356,246 | S | 3/1995 | Adams | |
| D356,492 | S | 3/1995 | Adams | |
| 5,496,005 | A | 3/1996 | Dieringer | 248/74.2 |
| D369,957 | S | 5/1996 | Blanton | |
| 5,531,411 | A | 7/1996 | Adams | 248/65 |
| 5,542,636 | A | 8/1996 | Mann et al. | 248/29.26 |
| 5,544,031 | A | 8/1996 | Blanton | 362/396 |
| 5,566,058 | A | 10/1996 | Protz, Jr. | 362/396 |
| D376,535 | S | 12/1996 | Gary et al. | |
| D376,973 | S | 12/1996 | Brown | |
| 5,581,956 | A | 12/1996 | Fennessy et al. | 52/28 |
| 5,607,230 | A | 3/1997 | Protz, Jr. | 362/396 |
| 5,609,415 | A | 3/1997 | Protz, Jr. | 362/396 |
| 5,669,709 | A | 9/1997 | Adams | 362/396 |
| 5,695,159 | A | 12/1997 | Adams | 248/71 |
| 5,772,166 | A | 6/1998 | Adams | 248/231.81 |
| 5,921,511 | A | 7/1999 | LaPointe | 248/73 |
| D414,291 | S | 9/1999 | Gary et al. | |
| D424,418 | S | 5/2000 | Gary et al. | |
| D424,419 | S | 5/2000 | Avinger | |
| D427,510 | S | 7/2000 | Gary et al. | |
| 6,076,938 | A | 7/2000 | Kinderman | 362/249 |
| 6,182,933 | B1 | 2/2001 | Rapp | 248/231.8 |

*Primary Examiner*—Ramon O. Ramirez
(74) *Attorney, Agent, or Firm*—The Halvorson Law Firm

(57) ABSTRACT

Described is a gutter clip that is useful for attaching linear systems, such ornamental light strings, misting systems and the like, to surfaces, such as gutters. The clip comprises a body with a clip portion and a linear system attachment portion that is on a side of the body opposite that of the gutter clip portion.

10 Claims, 4 Drawing Sheets

GUTTER CLIP FOR ATTACHMENT OF LINEAR SYSTEMS

FIELD OF THE INVENTION

The present invention relates to the field of devices for the attachment of linear systems, such as ornamental light strings, misting systems, and the like to surfaces, such as gutters attached to buildings.

BACKGROUND

Ornamental decoration of buildings during different holiday seasons is an increasingly popular past time for people. Much of the ornamental decoration is in the form of ornamental light strings, such as the well-known Christmas light strings. Popular locations for these ornamental light strings and other linear systems are gutters, roofs, roof fascia and eaves. Since these decorations are usually only applied for a few weeks, there is a need and demand for devices that allow the easy and removable attachment of these linear systems (ornamental light strings).

SUMMARY OF INVENTION

It is an object of the present invention to provide a device that allows for the easy and removable attachment of linear systems, such as ornamental light strings, misting systems and the like to surfaces such as gutters.

The novel features that are considered characteristic of the invention are set forth with particularity in the appended claims. The invention itself, however, both as to its structure and its operation together with the additional object and advantages thereof will best be understood from the following description of the preferred embodiment of the present invention when read in conjunction with the accompanying drawings. Unless specifically noted, it is intended that the words and phrases in the specification and claims be given the ordinary and accustomed meaning to those of ordinary skill in the applicable art or arts. If any other meaning is intended, the specification will specifically state that a special meaning is being applied to a word or phrase. Likewise, the use of the words "function" or "means" in the Description of Preferred Embodiments is not intended to indicate a desire to invoke the special provision of 35 U.S.C. §112, paragraph 6 to define the invention. To the contrary, if the provisions of 35 U.S.C. §112, paragraph 6, are sought to be invoked to define the invention(s), the claims will specifically state the phrases "means for" or "step for" and a function, without also reciting in such phrases any structure, material, or act in support of the function. Even when the claims recite a "means for" or "step for" performing a function, if they also recite any structure, material or acts in support of that means of step, then the intention is not to invoke the provisions of 35 U.S.C. §112, paragraph 6. Moreover, even if the provisions of 35 U.S.C. §112, paragraph 6, are invoked to define the inventions, it is intended that the inventions not be limited only to the specific structure, material or acts that are described in the preferred embodiments, but in addition, include any and all structures, materials or acts that perform the claimed function, along with any and all known or later-developed equivalent structures, materials or acts for performing the claimed function.

DETAILED DESCRIPTION OF PREFERRED EMBODIMENTS

Figure 2:
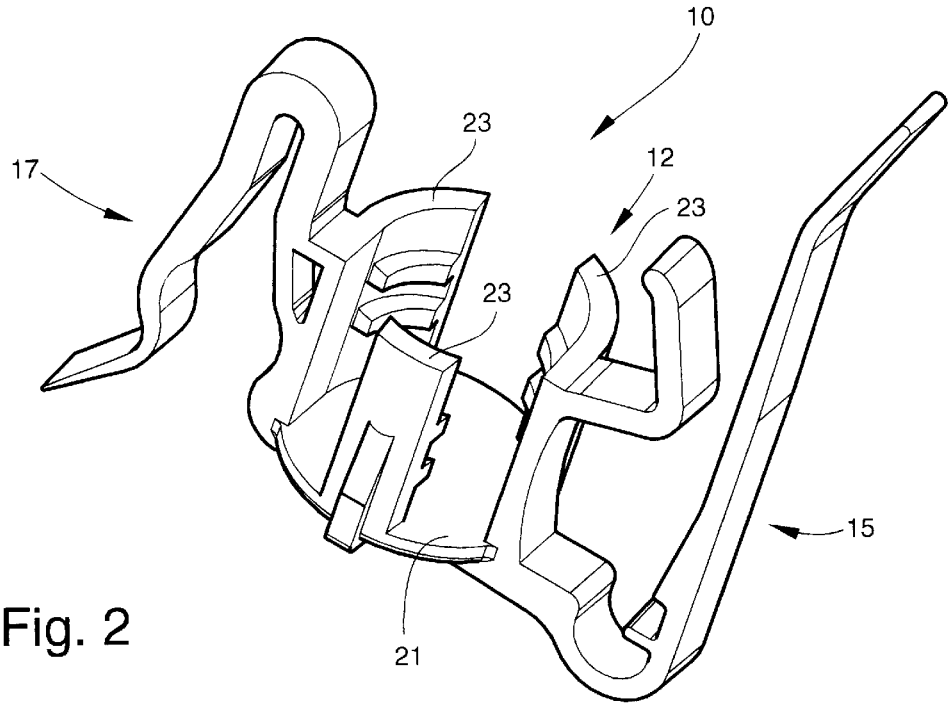
FIG. 2 is a second perspective view of the present invention.
Figure 1:
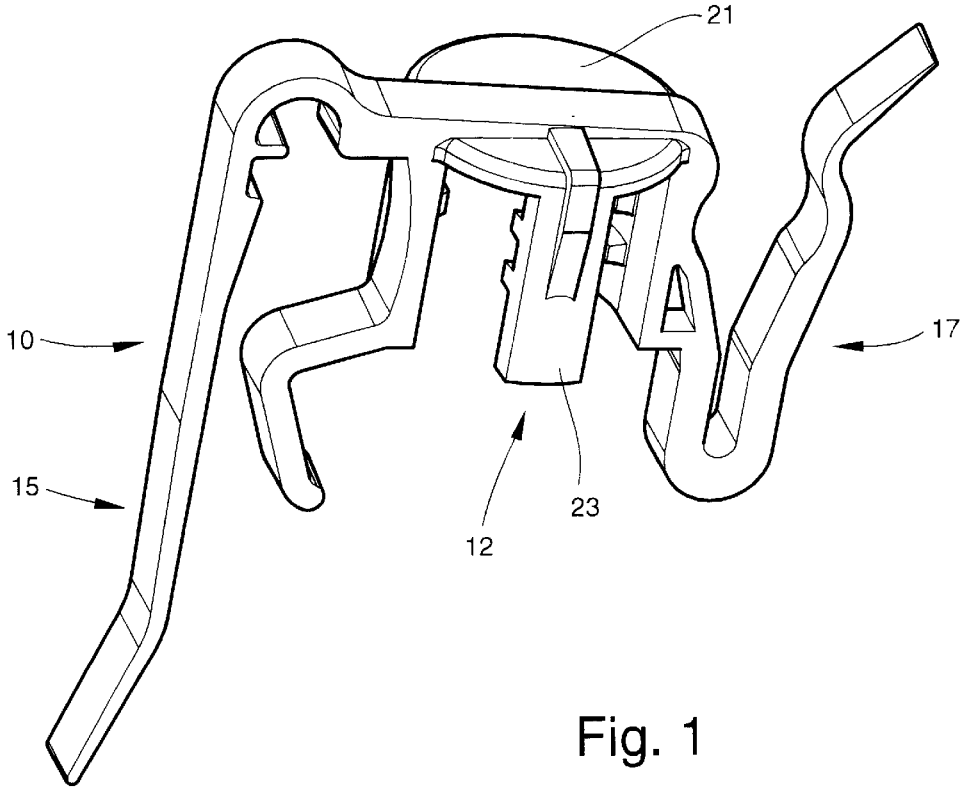
FIG. 1 is a perspective view of the present invention.
Figures 3, 4:
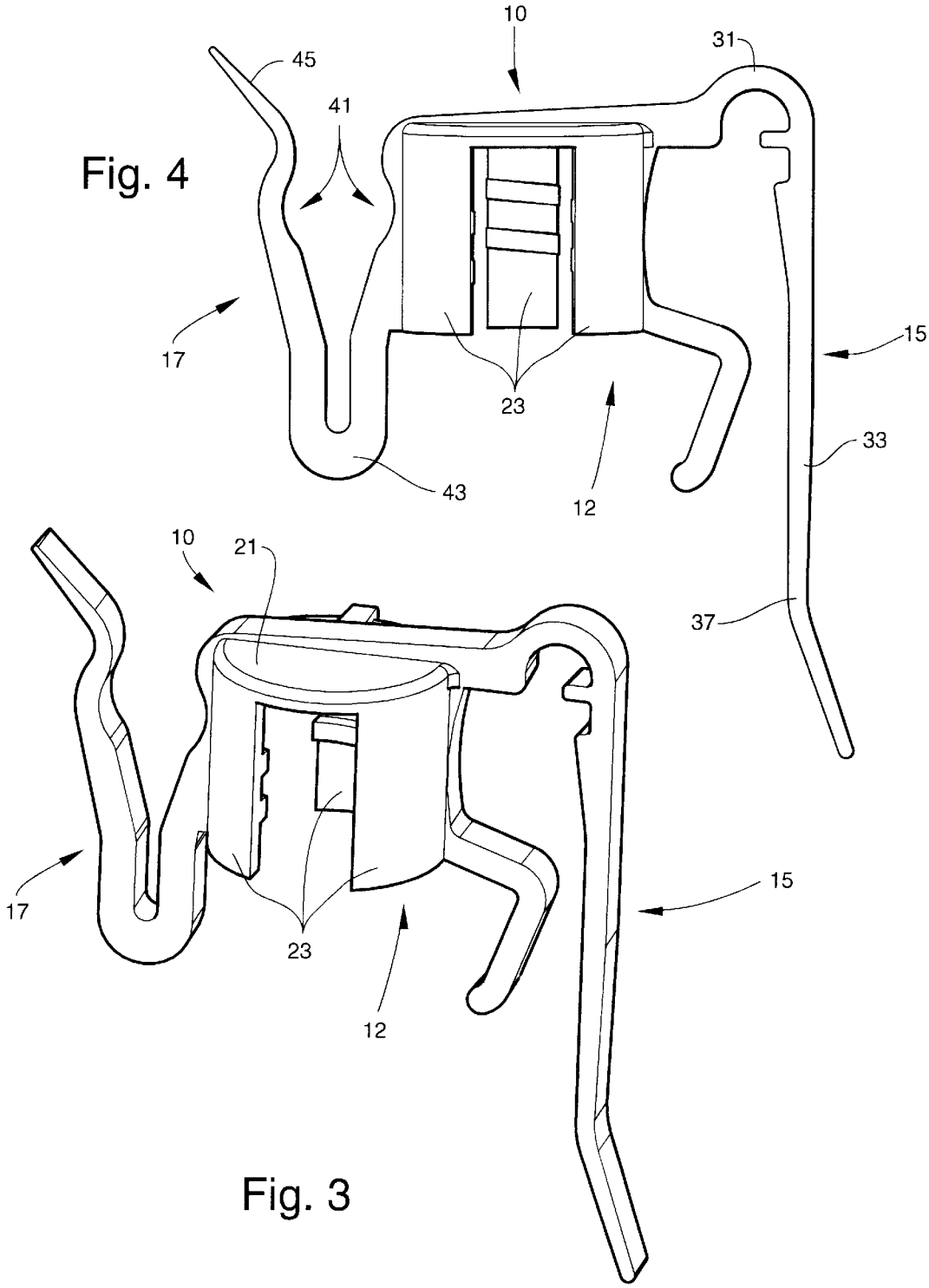
FIG. 3 is a third perspective view of the present invention.
FIG. 4 is a side view of the present invention.
Figure 6:
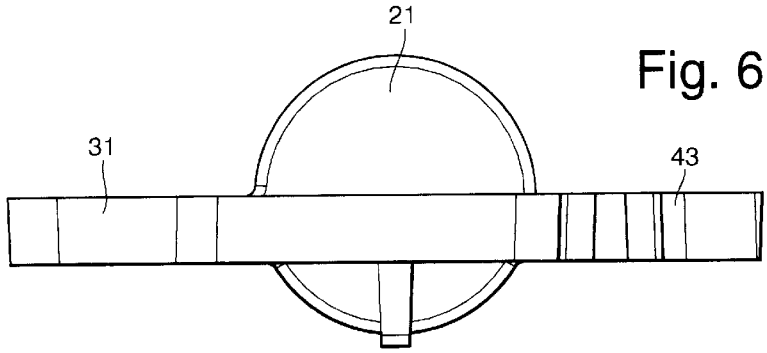
FIG. 6 is a top view of the present invention.
Figure 5:
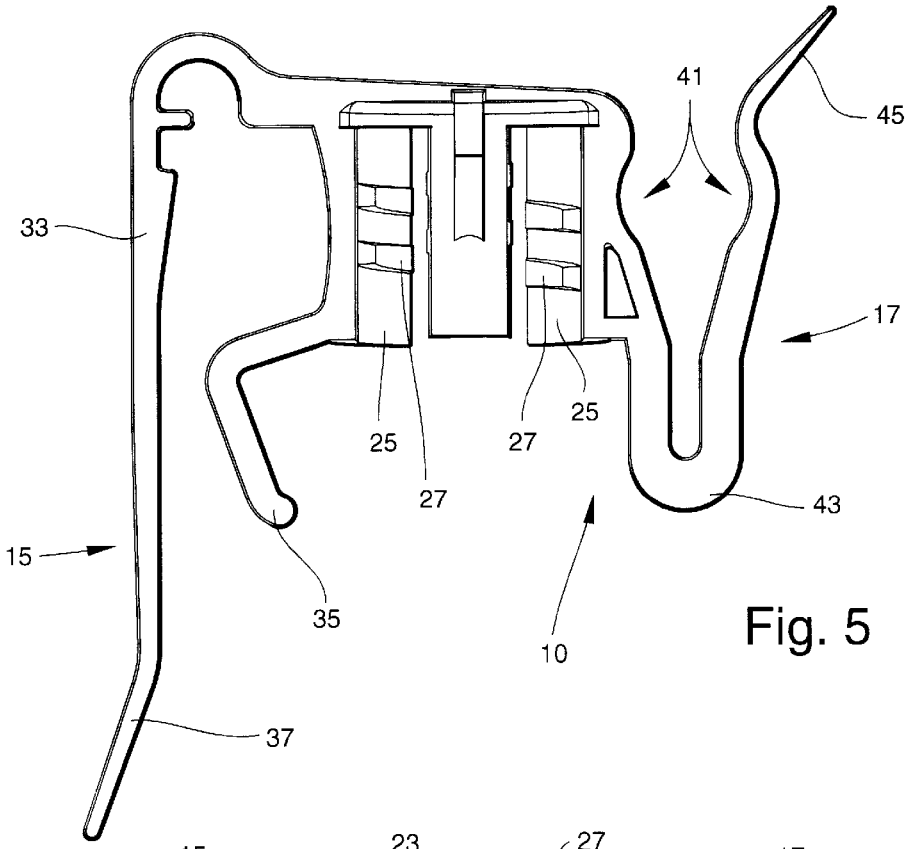
FIG. 5 is a second side view of the present invention.
Figure 7:
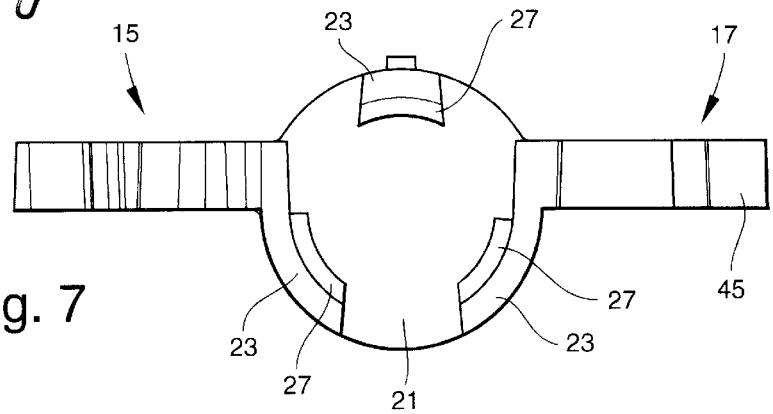
FIG. 7 is a bottom view of the present invention.
Figure 8:
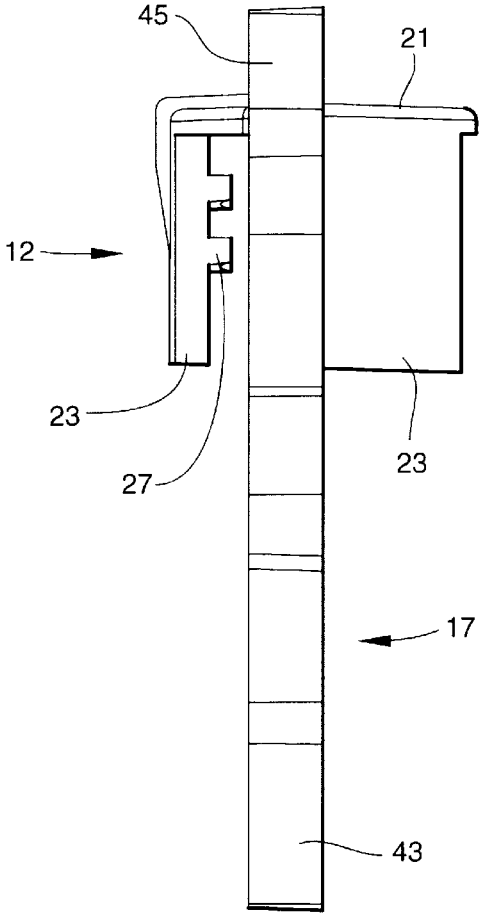
FIG. 8 is a front view of the present invention.
Figure 9:
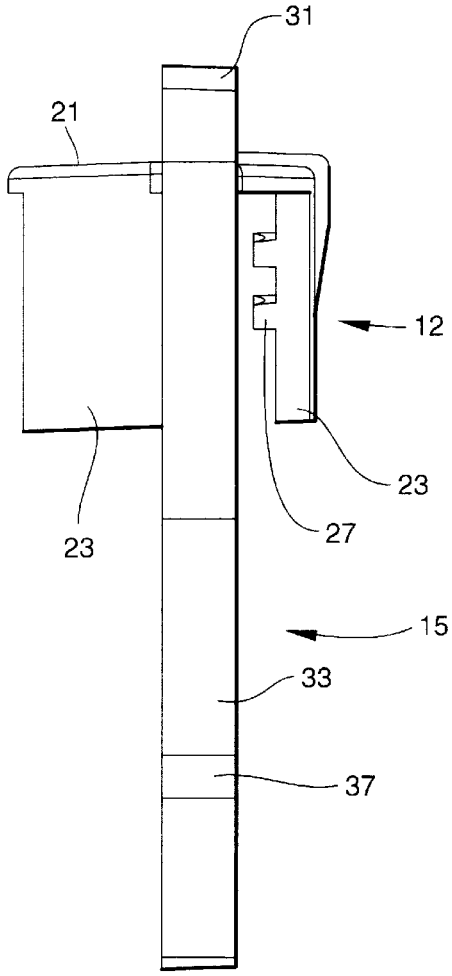
FIG. 9 is a rear view of the present invention.

The present invention is useful for attaching linear systems, such as ornamental light strings, misting systems and the like, to surfaces, such as gutters.

With reference to the figures, the present invention is a clip 10 that can be attached to surfaces, such as gutters. The clip 10 comprises a body 12 with a gutter clip portion 15 and a linear system attachment portion, 17, that is preferably located on a side of the body 12 opposite that of the gutter clip portion 15. It is recognized, however, that alternate locations of the gutter clip portion 15 relative to the linear system attachment portion 17 are possible and still fall within the scope of the present invention.

The body 12 comprises a top section 21 and at least two, preferably three, concave sections 23 that project downward from the top section 21. These concave sections 23 are located to provide an interrupted cylindrical form. In one embodiment, on inside surfaces 25 of the concave section 23 are at least one, preferably two or more thread sections 27. These thread sections 27 are provided to allow the body 12 to be threadingly received by a pole having threads at a distal end. In another embodiment (not shown), the thread sections 27 are not included and a pole may be inserted, preferably snuggly due to friction, directly into the interrupted cylindrical form.

In use, a threaded pole is screwed into the body 12. The user then attaches the clip portion 15 to a surface, such as a gutter by forcing the gutter clip portion 15 over a lip of the gutter, whereby the gutter clip portion 15 receives the lip of the gutter. Once the gutter clip portion 15 has been placed, the user then unscrews the threaded pole from the body 12, thereby leaving the entire clip 10 attached to the surface. In the embodiment where there is not thread sections 27, the pole may be removed by simply pulling down on the pole thereby leaving the clip 10 in place. Removal of the clip 10 is merely the reverse of the above or it may be removed by hand without use of the pole.

The gutter clip portion 15 comprises an arm 31 that projects from the body 12. At a distal end of the arm 31 a leg 33 projects perpendicular to the direction of the arm 31 and in the same direction the concave section 23 project. Thus, the leg 33 is substantially parallel to the concave section 23, but displaced in space by the length of the arm 31. The gutter clip portion 15 also comprises a gutter lip retention tab 35 that is located at a distal end of one of the concave sections 23 and adjacent the leg 33. In a preferred embodiment, the gutter lip retention tab 35 is L, or hook, shaped in order to provide a smooth continuous surface that aids receipt of a lip of a gutter. Other shapes for the gutter lip retention tab 35 may be used and still fall within the scope of the present invention.

Also in a preferred embodiment, the leg 33 has a slight angular bend 37 approximately in the middle of the leg 33 and away from the body 12 of clip 10, in order to further aid in the receipt of a lip of a gutter. The leg 33 may also include at least one rib(s) or barb(s) (not shown) located on the inward surface of the apex of the slight bend or angle. These at least one rib(s) or barb(s) are provided to increase the resistance of the clip portion 15 to unwanted movement.

As discussed above, the linear system attachment portion 17 is located in a side of the body 12 opposite that of the gutter clip portion 15. The linear system attachment portion 17 comprises a substantially C-shaped clip 41 interrupted by a flex segment 43 located near the middle of the C-shape. This flex segment 43 allows the diameter of the clip 41 to be expanded in order to receive differently sized items, such as ornamental light bulb sockets or misting systems and the like. Additionally, since the preferred embodiment of the flex segment 43 is a substantial U-shape, the U of the flex segment 43 may receive and hold linear systems, such as those used with ornamental light strings and misting systems. The inclusion of the flex segment 43 makes the linear system attachment portion 17 a multi-use element. Finally, the unattached end, distal, of the clip 41 may include an outwardly directed tang 45 that aids in the receipt of light bulb sockets, electrical strings or misting systems.

The preferred embodiment of the invention is described above in the Drawings and Description of Preferred Embodiments. While these descriptions directly describe the above embodiments, it is understood that those skilled in the art may conceive modifications and/or variations to the specific embodiments shown and described herein. Any such modifications or variations that fall within the purview of this description are intended to be included therein as well. Unless specifically noted, it is the intention of the inventor that the words and phrases in the specification and claims be given the ordinary and accustomed meanings to those of ordinary skill in the applicable art(s). The foregoing description of a preferred embodiment and best mode of the invention known to the applicant at the time of filing the application has been presented and is intended for the purposes of illustration and description. It is not intended to be exhaustive or to limit the invention to the precise form disclosed, and many modifications and variations are possible in the light of the above teachings. The embodiment was chosen and described in order to best explain the principles of the invention and its practical application and to enable others skilled in the art to best utilize the invention in various embodiments and with various modifications as are suited to the particular use contemplated.

What is claimed is:

1. A device for securing linear systems to surfaces comprising a body with an attached clip portion and linear system attachment portion, said body further comprising a top section and at least two concave sections that define an interrupted cylindrical form; said clip portion further comprising an arm that projects from the top section, a leg that projects from a distal end of the arm, and a tab that is located at a distal end of one of the concave sections and adjacent the leg.

2. The device according to claim 1 wherein the at least two concave sections further include thread sections located on inside surfaces thereof.

3. The device according to claim 1 wherein the linear system attachment portion is located on a side of the body opposite that of the clip portion and further comprises a substantially C-shaped clip.

4. The device according to claim 3 wherein the linear system attachment portion further comprises a flex segment located near the middle of the C-shaped clip.

5. The device according to claim 4 wherein the linear system attachment portion further comprises an outwardly directed tang located at a distal end of the C-shaped clip.

6. The device according to claim 5 wherein the at least two concave sections further include thread sections located on inside surfaces thereof.

7. The device according to claim 4 wherein the at least two concave sections further include thread sections located on inside surfaces thereof.

8. The device according to claim 3 wherein the at least two concave sections further include thread sections located on inside surfaces thereof.

9. The device according to claim 1 wherein the leg further comprise a slight bend, with the vertex of the slight bend directed inward.

10. The device according to claim 9 wherein the at least two concave sections further include thread sections located on inside surfaces thereof.

* * * * *